US006102836A

United States Patent [19]

Person

[11] Patent Number: 6,102,836

[45] Date of Patent: Aug. 15, 2000

[54] PERSONAL WALL EXERCISER FOR STRENGTHENING BACK ARMS AND LEGS

[76] Inventor: Norman D. Person, 609 S. 7th St., Knoxville, Iowa 50138

[21] Appl. No.: 09/236,047

[22] Filed: Jan. 22, 1999

[51] Int. Cl.[7] ..... A63B 21/06

[52] U.S. Cl. ..... 482/103; 482/97; 482/102

[58] Field of Search ..... 482/94, 90, 97, 482/99, 102, 103, 112, 129, 130, 133

[56] References Cited

U.S. PATENT DOCUMENTS

| | | | |
|---|---|---|---|
| 43,149 | 6/1864 | Wood . | |
| 232,579 | 9/1880 | Weeks . | |
| 418,257 | 12/1889 | Whitley . | |
| 546,568 | 9/1895 | Whitely . | |
| 705,266 | 7/1902 | Mattsson . | |
| 722,462 | 3/1903 | Smith | 482/102 |
| 754,992 | 3/1904 | Grabner . | |
| 1,123,570 | 1/1915 | Sandow . | |
| 4,650,185 | 3/1987 | Cartwright | 482/97 |
| 4,721,303 | 1/1988 | Fitzpatrick . | |
| 4,784,384 | 11/1988 | Deola . | |
| 5,123,886 | 6/1992 | Cook . | |
| 5,201,694 | 4/1993 | Zappel . | |
| 5,211,614 | 5/1993 | Henes . | |
| 5,298,004 | 3/1994 | Davis | 482/103 |
| 5,601,518 | 2/1997 | Weintraub . | |

FOREIGN PATENT DOCUMENTS

| | | | |
|---|---|---|---|
| 208551 | 4/1984 | Germany | 482/97 |

*Primary Examiner*—John Mulcahy
*Attorney, Agent, or Firm*—Zarley,Mckee, Thomte, Voorhees & Sease

[57] ABSTRACT

An exercise device and method includes a frame, a source of resistance, a rope extending from the source of resistance, and a free end of the rope that can be grasped by or attached to an exerciser. A second resistance and a second rope are also associated with the frame. The ropes and resistances are movable independent of one another. The ropes can be moved in any of a plurality of directions. The exercise device and method therefore provide a variety of different exercises and exercise benefits from one machine including independent movement for two ropes.

11 Claims, 5 Drawing Sheets

PERSONAL WALL EXERCISER FOR STRENGTHENING BACK ARMS AND LEGS

BACKGROUND OF INVENTION

The present invention relates to exercising, and in particular, to an exercise device and method.

Problems in the Art

Personal fitness is important to a large number of people. Numerous attempts have been made at creating an exercise device which will assist a user towards physical fitness.

Types of exercise devices which have been developed range from very expensive to low cost. They range from large sized equipment which on a practical level can only be installed and used at large gymnasiums, to relatively small portable devices usable at home.

The home exercise and fitness market is substantial. It is generally preferred to have devices which do not need permanent installation, or at least do not require substantial installation, and which are relatively space saving. The cost is also many times important.

The cost can be directly correlated in many instances with the number and variety of exercises capable to be practiced with the device. It is generally preferred that there be multiple exercise advantages and varieties available with one machine.

While there are a number of choices in the personal home exercise device market, there remain the foregoing discussed needs in the art. It is therefore a principal object of the present invention to provide a means and method for an exercise device which improves over or solves the problems and deficiencies in the art.

Further objects, features, and advantages of the present invention include an exercise device and exercise method as above described which:

1. Has a variety of exercises and exercise capabilities, including hands, arms, feet, legs, and different exercises for each of those body parts.
2. Does not require extensive reconfiguration for different exercises.
3. Is adjustable in the resistance it provides.
4. Occupies a relatively small amount of space.
5. Is economical, efficient, and durable.

These and other objects, features, and advantages of the present invention will become more apparent with reference to the accompanying specification and claims.

SUMMARY OF THE INVENTION

The invention includes a frame, a first resistance device mounted on the frame, and a first rope having a free end and an opposite end connected to the first resistance member. Movement of the free end of the rope in any of plurality of directions provides a resistance and exercise benefit to such movement. A second resistance member is mounted to the frame and a second rope having a free end and an opposite end connected to the second resistance device allows movement of the free end of the second rope in a plurality of directions to provide a resistance and exercise benefit to such movement independent to the exercise resistance and benefit of the first rope. Therefore, the exerciser can conduct two exercise movements independently of one another.

DETAILED DESCRIPTION OF THE PREFERRED EMBODIMENT

Figure 1:
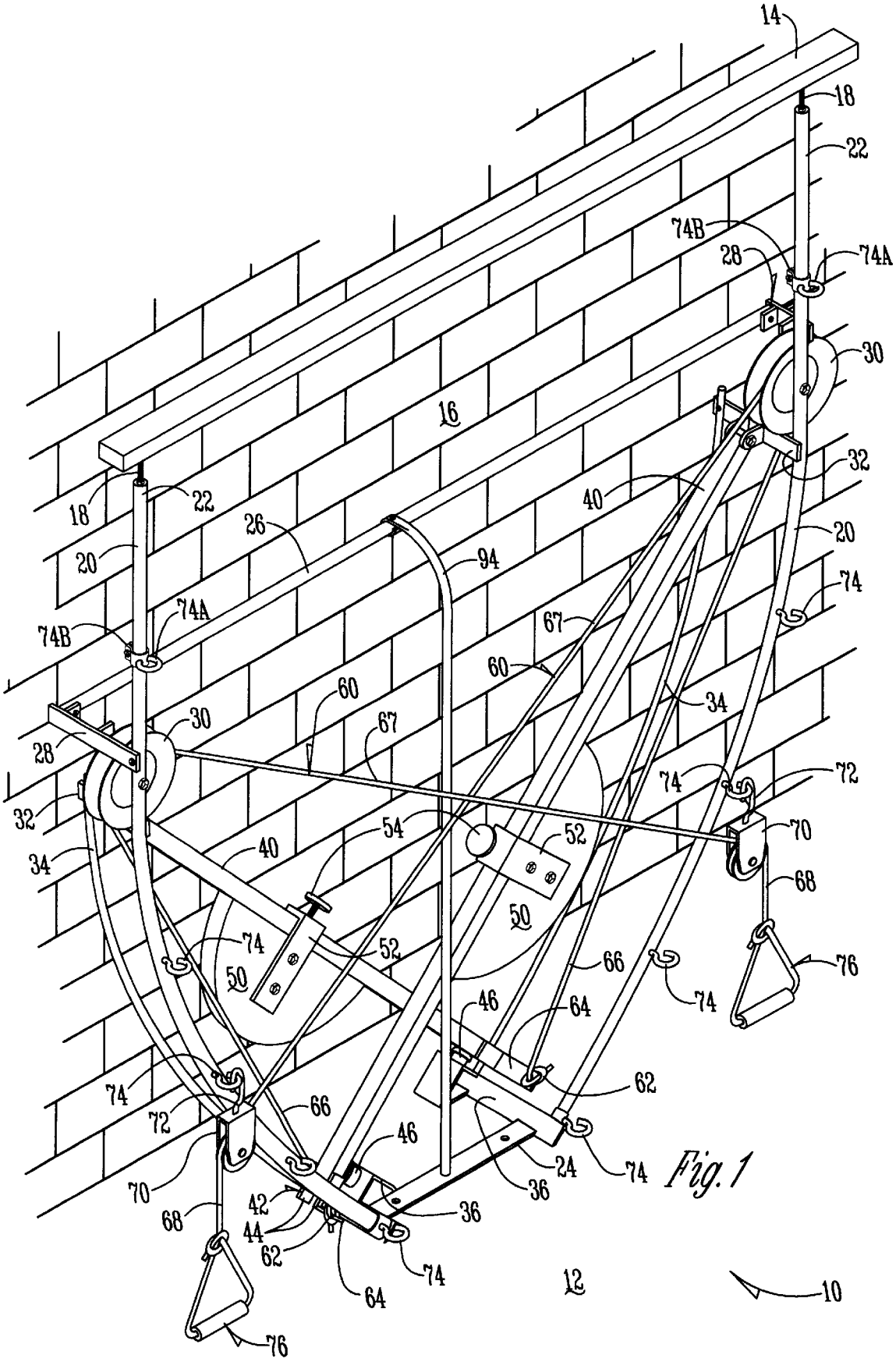
FIG. 1 is a perspective view of a preferred embodiment according the present invention in an installed position.

To provide a better understanding of the invention, a detailed description of one preferred embodiment will now be set forth. Frequent reference will be taken to the drawings. Reference numerals will be used to indicate certain parts and locations in the drawings. The same reference numerals will indicate the same parts and locations throughout the drawings unless otherwise indicated.

Figure 2:
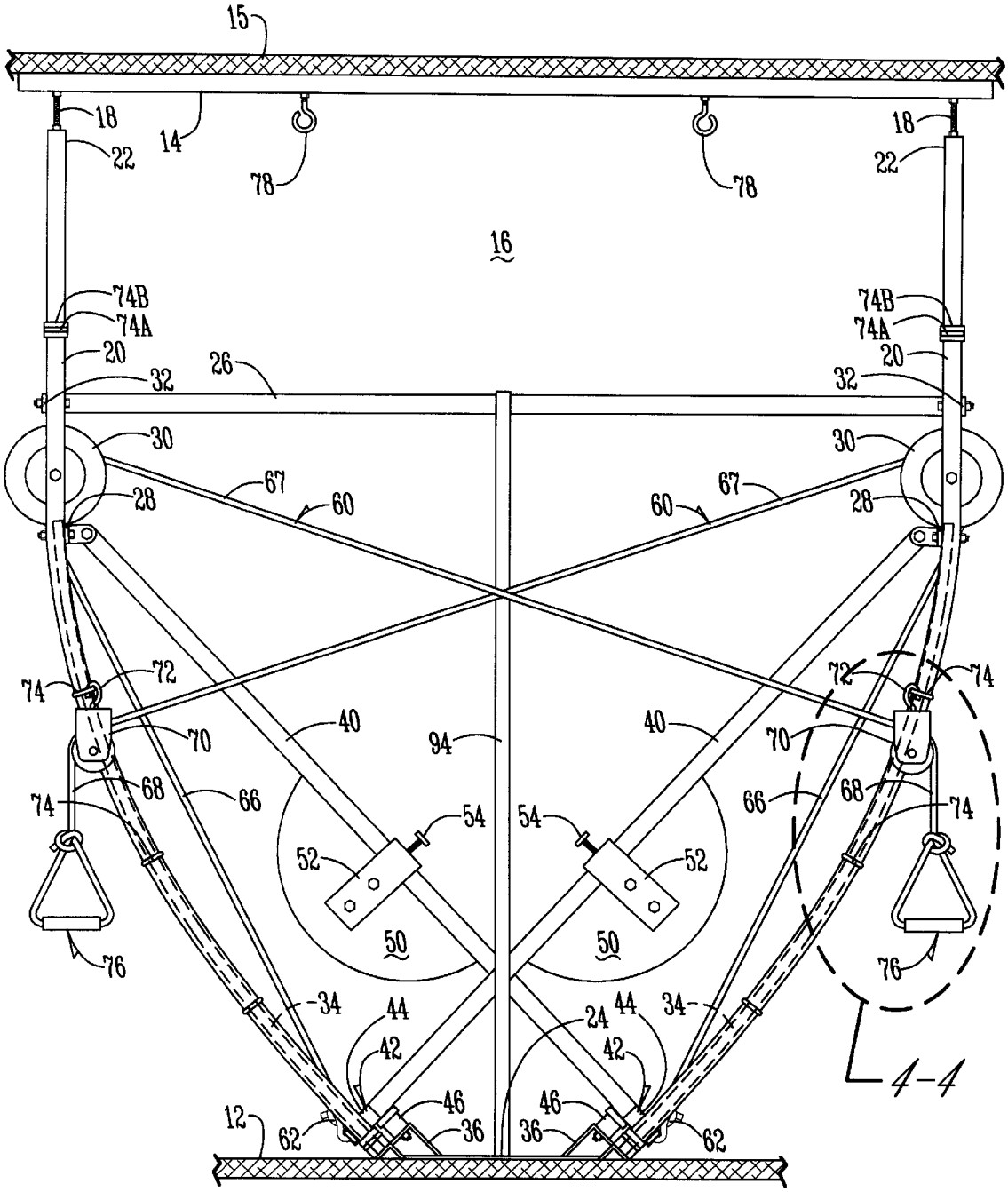
FIG. 2 is a front elevational view of FIG. 1.

FIG. 1 illustrates exercise device 10 installed between a floor 12 and a board 14 parallel to but slightly spaced apart from wall 16. It is to be understood (as shown in FIG. 2) that board 14 would fit against a ceiling or floor joist, or other structural support at or near the ceiling of the room. Device 10 therefore can be vertically positioned between floor and ceiling. All thread jacks 18 exists between board 14 and upper ends of curved side frames 20. All thread jacks 18 allow board 14 to be adjusted to essentially wedge device 10 between floor 12 and ceiling 15. No bolts, brackets, or other hardware need to be used to install device 10.

In addition to curved side frames 20, the general frame of device 10 includes a bottom frame 24, connecting the bottom ends of curved side frames 20, and a center bar 26 that extends between two pulley brackets 28 which mount fixed pulleys 30 to the upper part of each curved side frame 20. Pivot brackets 32 function to support one end of guide rails 34 which consist of a curved rod having an opposite end connected to rearward foot 36 on the opposite sides of bottom frame 24.

Pivot brackets 32 also function to pivotally connect weight arms 40 at one end. A bracket 42, consisting essentially of two parallel outward extending fingers 44, slides along guide rail 34 between a lower position against a bumper 46 at the end of rearward foot 36, to an upper position adjacent to fixed pulley 30. FIG. 1 shows both weight arms 40 in the lower position.

A weight 50, here a semi-circular piece mace of steel, cement, or other material of substantial mass, is adjustably positioned along weight arm 40 by bracket 52 and set screw 54.

To complete the basic structure of device 10, a rope 60 has a first or proximal end 62 tied to an extension 64 from bracket 52 at the lower end of weight arm 40. A first segment 66 of rope 60 extends from proximal end 62 up and over the outside of pulley 30. A second segment 67 of rope 60 extends from pulley 30 to a mobile pulley 70 that is mounted by hook 72 to an eye bolt 74 along curved side frame 20. A third segment 68 of rope 60 extends from mobile pulley 70 to a stirrup handle grip 76.

As can be seen in FIGS. 1 and 2, a rope 60 exists for each weight arm 40. The two stirrup handle grips 76 in the configuration shown in FIGS. 1 and 2 are mounted at a somewhat intermediate vertical position relative to device 10 and are spaced apart. As can be appreciated, if a stirrup grip 76 is pulled, rope 60 would pull lower end of the associated weight arm 40 upwardly along guide rail 34 and away from its resting location against bumper 46. Immediately when raised off bumper 46, weight 50 and weight arm 40 would provide a resistance to further pulling of ropes 60. As can be further appreciated, the farther up rail 34 weight arm 40 is moved, generally increasing resistance is generated. The resistance continues if rope 60 is then allowed to move back towards mobile pulley 70 until weight arm 40 rests again against bumper 46.

The opposite rope works in identical fashion with respect to the opposite weight arm 40. Therefore, it can be appreciated that a user can grip one or both hand grips 76 and pull the corresponding rope or ropes 60 one at a time or together. The movement of weight arms 40 is independent of one another.

Figure 3:
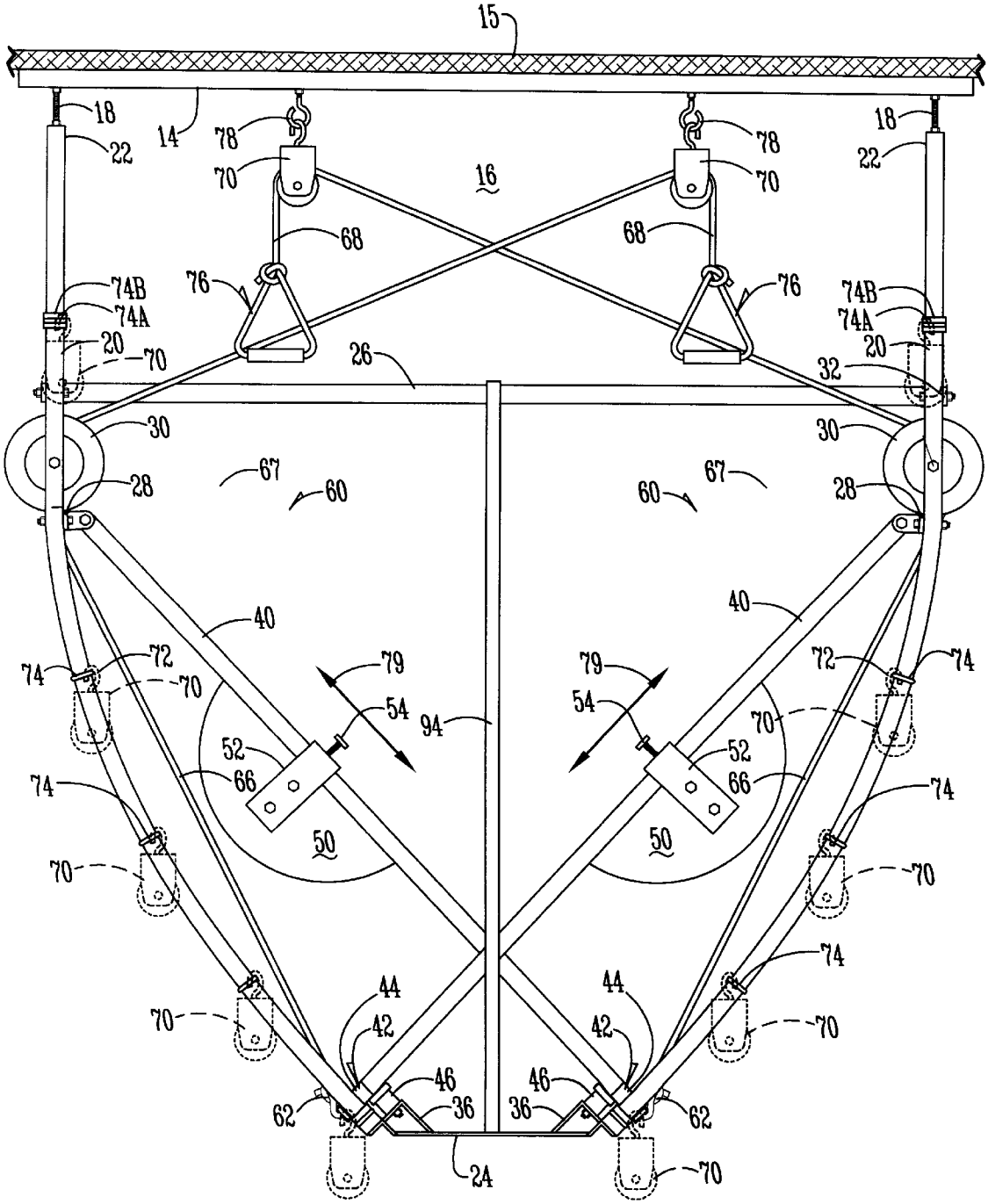
FIG. 3 is similar to FIG. 2 but shows an adjusted configuration of the exercise device of FIG. 2.

FIG. 3 illustrates in ghost lines how mobile pulleys 70 could be positioned at any of a number of positions along curved side frames 20. By simply lifting mobile a pulley 70 off of a respective eye bolt 74, and transferring it to a different eye bolt 74, different exercise could be accomplished. Still further FIG. 3 shows that eye bolts 78 could be placed even along board 14 and mobile pulley 70 connected thereto for still further different exercise features. FIG. 1 shows eye bolts 74A are slideable vertically along side frames 20 for different positions and can be adjustably fixed in place by tightening screws 74B.

FIG. 3 also illustrates by arrows 79 the adjustability of weights 50 along weight arms 40. The lower along weight arm 40 that weight 50 is moved, the more resistance it would provide because it would be moving a farther distance from the pivot point of weight arm 40.

Figure 4:
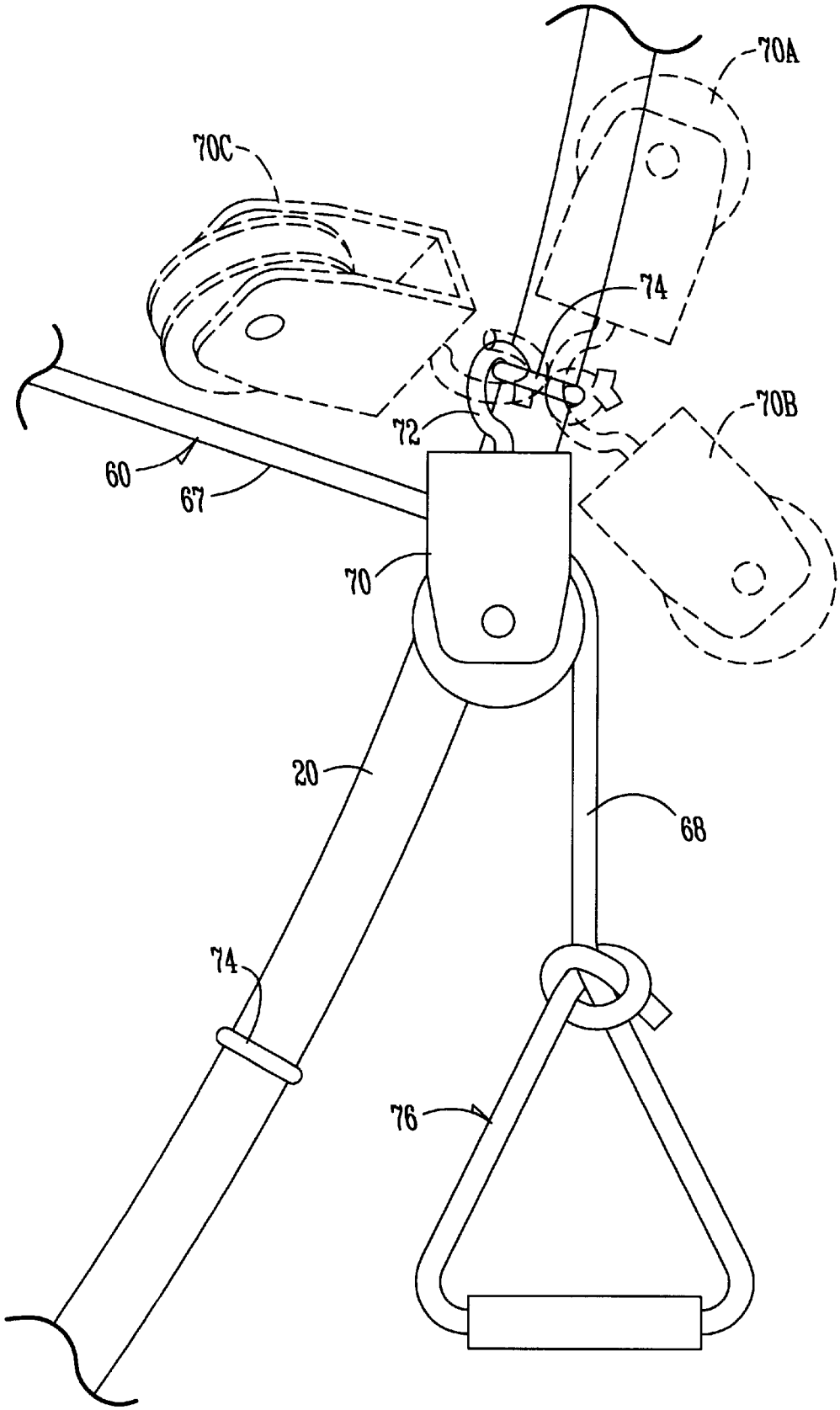
FIG. 4 is an enlarged view of the portion of FIG. 2 indicated at line 4—4 and shows in ghost lines adjustability of that component.

FIG. 4 illustrates that the hook 72 into eye bolt 74 connection for mobile pulley 70 allows mobile pulley 70 to be turned in a plurality of different directions. As can be appreciated, this also allows for a variety of different exercises. The user could pull the rope vertically downward to achieve a certain exercise benefit. The user could pull the rope upwardly (see reference numeral 78). It could be pulled angularly downwardly and outwardly (reference numeral 70B). It could be pulled angularly inwardly and forwardly (reference numeral 70C). These are a handful of different directions rope 60 could be pulled and it is to be understood that a complete adjustability of orientation of mobile pulley 70 can allow almost infinite adjustment of direction of pulling.

Operation of the invention is as follows. A user grasps at least one stirrup hand grip 76 and stands in a selective position relative to device 10. The user could be standing with back facing device 10, front facing device 10, or sideways or any position. The user then pulls the hand grip 76 in a selected direction out of the multiple different possible directions available because of mobile pulley 70 and its attachment to curved side frame 20. Weight arm 40 would provide resistance to such pulling as it moves upward (see ghost lines in FIG. 5) from its resting position (solid lines in FIG. 5). Bracket 42 keeps arm 40 aligned along rail 34. The exerciser would decide how much rope 60 would be pulled for a given exercise repetition. Because resistance exists both during pulling and retracting until weight arm hits bumper 46, exercise benefit occurs throughout the whole repetition. Once a repetition is done, the user can repeat the identical movement or can select a different movement.

Alternatively, the user could grasp both hand grips 76 and move the hand grips 76 in parallel paths. Alternatively, different paths for each hand grip could be followed for different exercise benefits for either arm. Still further, one hand grip 76 could be moved in a path and then back, followed by a similar or different movement by the other hand grip so that each arm could be alternately exercised.

Resistance through the exercise movements could be easily adjusted by the user by adjusting weights 50 along weight arm 40. Different exercises could be easily and quickly accomplished by moving mobile pulleys 70 to different eye bolts 74.

Thus it can be seen that the device 10 accomplishes at least the stated objectives, features, and advantages of the invention. Device 10 is relatively thin front to back and therefore does not take up very much space. It is structurally strong and can utilize ceiling and floor to avoid having permanent installation. It is economical because of its structure and operation. It provides a wide range of different exercises and exercise benefits. It is easily adjustable for different exercises.

It will be appreciated that the present invention can take many forms and embodiments. The true essence and spirit of this invention are defined in the appended claims, and it is not intended that the embodiment of the invention presented herein should limit the scope thereof.

Figure 5:
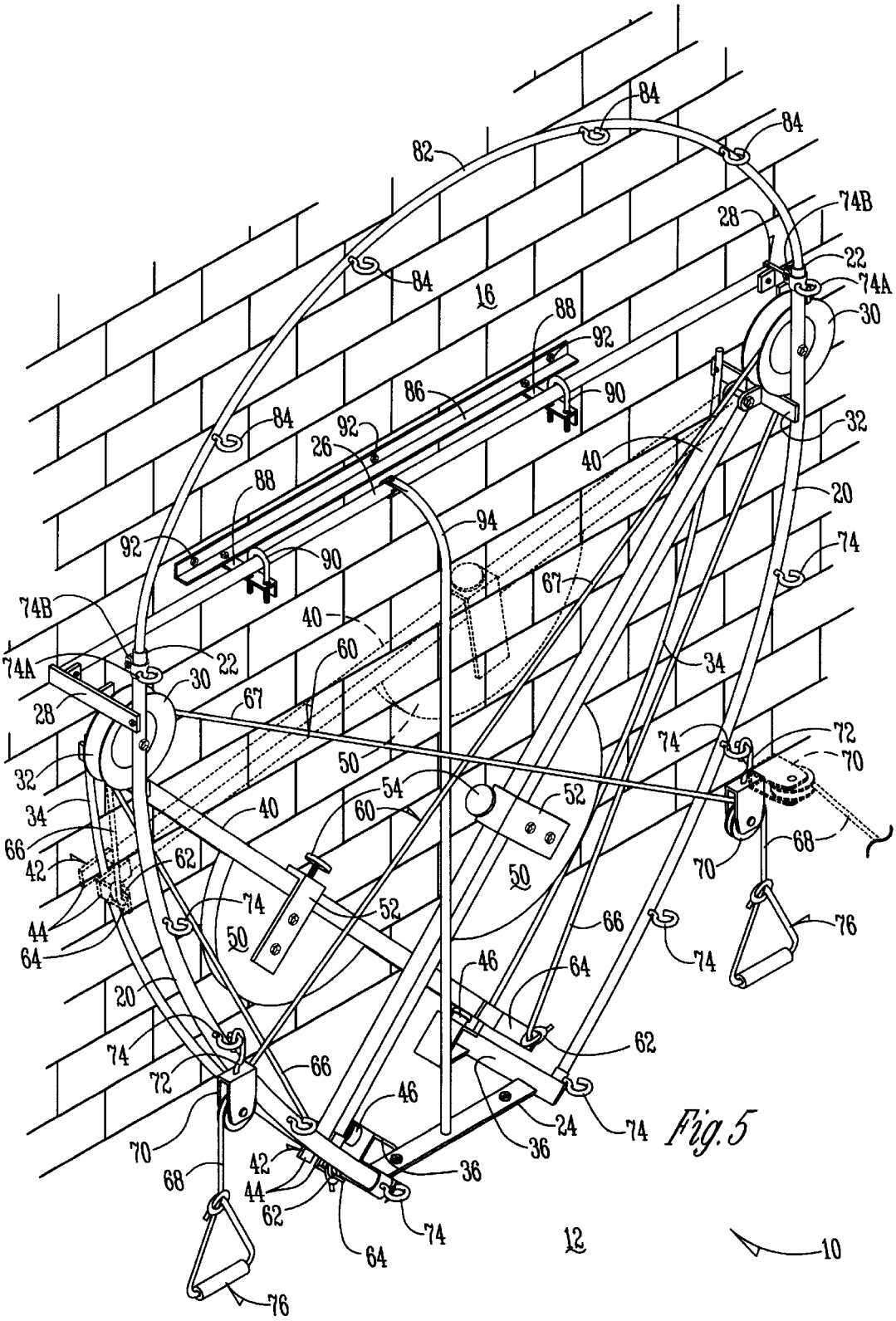
FIG. 5 shows an alternative mounting method and structure for an exercise device according to the invention.

For example, FIG. 5 illustrates device 10 with the following differences from that shown in FIG. 1. Instead of the curved side frame 20 extending vertically to the ceiling, they are truncated and a curved rod 82 is inserted into the upper ends of opposite curved side frames 20. Eye bolts 84 are positioned along curved rod 82 and provide still further optional positions for mobile pulleys 70. A brace 86 made up of an elongated angle iron piece is removably mounted to center bar 26 by brackets 88 and U bolts 90. Cement or masonry screws or bolts, or other fasteners 92 could be used to fix brace 86 to a wall and thus hold the exercise device 10 in position. Bottom frame 24 could also be fastened to the floor if needed.

The basic components of device 10 can be made of tubular steel or aluminum, or other similar materials. One skilled in the art would know the structural strength and rigidity needed for the various components. The dimensions of device 10 can vary. However the dimensions of the preferred embodiment can be deduced by the drawings showing the device installed between a floor and perhaps a 7 or 8 foot high ceiling, although the device could work for different height ceilings by obvious extensions of frame members. Side framse 20 can be approximately 83¾" in height with the lower portion having a 62" radius curve. Weight arms 40 can be 60" long.

Bar 94 extends from bottom frame 24 up to center bar 26. It serves to keep ropes 60 from being entangled with arms 40 and also to provide some guard against the user falling back into the area where arms 40 move.

Note too that arms 40 have to be offset slightly so that they can move in their respective parallel vertical planes without interfering.

Guards can be put on opposite sides of the pulleys to attempt to protect rope 60 from moving out of the pulley or frame.

What is claimed is:

1. An exercise machine comprising:

a frame having an upper end and a lower end;

first and second arms, each having one end pivotally mounted to the frame and the other end movable over a range of positions relative to the frame;

first and second ropes each having a distal end for grasping by or attachment to an exerciser;

the proximal end of each rope attached to an arm, the distal end of each rope threaded through a pulley fixed on the frame and a movable pulley adjustably positionable to a plurality of connections on the frame, the connections on the frame located along an arc generally equidistant from the fixed pulley;

independently adjustable resistance associated with each arm, comprising a weight that is adjustably positionable along a said arm;

the arms independently movable with respect to the frame;

so that an exerciser can move the distal end of either or both ropes and effect independent resistance and movement relative to each rope.

2. The machine of claim 1 is the machine of claim 1 the frame further comprising a curved portion over a section of which the arm is slideably mounted and movable.

3. The machine of claim 1 wherein the arms are pivotably mounted at positions closer to the upper end of the frame than the lower end of the frame.

4. The machine of claim 3 further comprising said other end of each arm having a resting position towards the lower end of the frame.

5. The exercise machine of claim 1 further comprising said movable pulleys adjustably positionable over a variety of positions on the frame, and positioned between the distal end of the first and second ropes and the fixed pulleys.

6. The machine of claim 5 wherein at least one movable pulley is attachable to the frame by a mount that allows orientation of the pulley in a variety of directions.

7. The machine of claim 1 wherein the fixed pulleys are rotatable in a plane that is parallel or identical substantially with the plane of movement of the arms.

8. An exercise machine comprising:

a frame;

a first resistance member mounted on the frame, the first resistance member comprising a first arm pivotally mounted to the frame, said first arm including a weight adjustable therealong;

a first rope;

the proximal end of the first rope attached to the first arm, the first rope threaded through a first pulley and a first movable pulley adjustably positionable to a first plurality of connections on the frame, the first plurality of connections on the frame located along an arc generally equidistant from the first pulley;

such that movement of the distal end of the first rope in any of a plurality of directions provides a resistance to such movement for exercise purposes;

a second resistance member mounted on the frame, the second resistance member comprising a second arm pivotally mounted to the frame, said second arm including a weight adjustable therealong;

a second rope;

the proximal end of the second rope attached to the second arm, the distal end of the second rope threaded through a second pulley and a second movable pulley adjustably positionable to a second plurality of connections on the frame, the second plurality of connections on the frame located along an arc generally equidistant from the second pulley;

such that movement of the distal end of the second rope in any of a plurality of directions provides a resistance to such movement for exercise purposes;

the first and second ropes being independently movable.

9. An exercise device comprising:

a frame;

a curved rail on the frame;

an arm having an end which slides along the rail;

the opposite end of the arm extending away from the rail to a pivot mechanism on the frame;

a weight mounted to the arm, the weight adjustably movable along the arm to provide variable resistance to moving the arm;

a rope attached to the arm extending to a first pulley on the frame and to a second pulley attached to the frame;

the second pulley pivotally attached to the frame at one of a plurality of connecting positions on the frame, said connecting positions lying along an arc generally equidistant from the first pulley;

the rope extending from the second pulley to free end of the rope.

10. A method of exercising comprising:

moving the distal end of a first rope in any of a plurality of directions relative to a movable pulley adjustably positioned at one of a plurality of connection points on a frame;

presenting resistance against such movement;

independently moving a second rope in any of a plurality of directions relative to a movable pulley adjustably positioned at one of a plurality of connection points on the frame;

presenting resistance against such movement;

the resistance relative to each rope created by a weight adjustably positionable on an arm pivotally connected to a frame;

the connection points for each rope lying along an arc generally equidistant from respective fixed pulleys through which each rope passes between the arm and movable pulley to which the rope relates;

so that movement of any rope can be in a variety of directions for a variety of exercises and independently relative to any other rope.

11. The method of claim 10 further comprising adjusting the vertical elevation of the rope for different resistance directions.

* * * * *